United States Patent [19]

Moscatelli

[11] Patent Number: 4,856,113

[45] Date of Patent: Aug. 15, 1989

[54] PROTECTIVE GARMENT FOR OPERATION IN CONTAMINATED AREAS

[75] Inventor: Romano Moscatelli, Rome, Italy

[73] Assignee: Sekur S.p.A., Milan, Italy

[21] Appl. No.: 186,019

[22] Filed: Apr. 25, 1988

[30] Foreign Application Priority Data

Apr. 30, 1987 [IT] Italy ..... 20317 A/87
Feb. 25, 1988 [IT] Italy ..... 19533 A/88

[51] Int. Cl.[4] ..... A41D 10/00
[52] U.S. Cl. ..... 2/84
[58] Field of Search ..... 2/84, 114, DIG. 7, 79, 2/69.5, 81

[56] References Cited

U.S. PATENT DOCUMENTS 2,773,263 12/1956 Pompa .
4,293,947 10/1981 Melarvie .
4,577,348 3/1986 Hoffmann ..... 2/84
4,792,040 12/1988 Wagstaff, III ..... 2/84 X

FOREIGN PATENT DOCUMENTS 0097541 1/1984 European Pat. Off. .
1562097 2/1969 France .
2260962 9/1975 France .

*Primary Examiner*—Ronald Feldbaum
*Attorney, Agent, or Firm*—Stevens, Davis, Miller & Mosher

[57] ABSTRACT

A protective garment in the form of a suit comprising gloves, boots, hood and facial mask. The suit is provided on its back region with a vertically extending slit which can be tightly closed by a zipper. Inside the garment, two protective skirts are respectively fastened along opposite portions of the slit; these are mutually connected by auxiliary protective portions situated at the opposite ends of the slit. The protective skirts are provided with respective gripping handles adapted to bring them, together with the auxiliary portions, from a rest position in which they are enclosed within the garment, to an operative position in which they are reversed astride the corresponding edges of the slit.

9 Claims, 3 Drawing Sheets

PROTECTIVE GARMENT FOR OPERATION IN CONTAMINATED AREAS

This invention relates to a protective garment allowing operation in contaminated areas, of the type comprising an impermeable suit provided with boots, gloves, a hood and a facial mask, as well as with at least one slit to be opened, along the opposite edges of which are disposed tight closing means.

As known, during operation in contaminated areas it is necessary for the operators to wear special protective garments constructed in such a way that the user is not exposed to direct contact with the contaminants present in that area, be they solid, liquid or gaseous.

Garments of this kind are composed in general of a completely impermeable suit provided with boots, gloves, hood and facial mask, worn through a wide slit which can be tightly closed by means of a suitable zipper or the like.

These garments moreover are provided with aeration means, adapted to convey clean air inside the garment itself. The air so admitted is then expelled through appropriate valves arranged and adjusted in such a manner as to maintain inside the garment a pressure slightly higher than atmospheric pressure, thus preventing air coming from the exterior from penetrating inside the garment.

By virtue of these arrangements, the wearer is efficiently protected during the whole time required for his activity.

Upon leaving the contaminated area the wearer upon taking off the garment must be prevented from contacting any contaminants which may have been deposited on the outer surface of the garment. To this end the garment, before being taken off, must be subjected to an appropriate decontamination treatment, such as by washing, to remove these contaminants.

Unfortunately, it may sometimes happen that the decontamination treatment is not sufficient to eliminate all of the contaminating substances deposited on the garment. In fact, there are substances which, by their very nature, adhere almost permanently to the garment and whose total elimination would require excessively long treatment times and/or the exposure of the garment to high temperatures impossible to be withstood by the operator within.

As the wearer, in taking off the garment, is always liable to touch its outer surface at the slit edges, an incomplete decontamination treatment represents a risky situation for the safety of the wearer.

Further, it has to be taken into account that, to reduce this risk to the utmost, it is necessary to reduce considerably the time of stay of the operator in the contaminated area.

This complicates carrying on the required operations, since the latter must be effected in different successive times or by means of repeated turnover of personnel.

The present invention aims at eliminating all of the foregoing disadvantages by providing a protective garment able to ensure the wearer's safely even if—when the garment is taken off—contaminating substances are still present on its outer surface.

These and other objects of the invention, which will be more fully understood from the present specification, are substantially achieved by means of a protective garment for operation in contaminated areas, of the type comprising an impermeable suit provided with boots, gloves, hood and facial mask, as well as with at least one slit which can be opened, and along the opposite edges of which operate tight closing means, characterized in that it comprises at least one pair of protective skirts secured inside the garment along opposite sides of the slit, the skirts being provided with gripping means adapted to be brought from a rest position, in which they are enclosed within the garment and extend in opposite directions, to an operative position in which each skirt is reversed astride or across the corresponding edge of the slit.

Further characteristics and advantages of this invention will be more clearly apparent from the following detailed description of a preferred, but not exclusive, embodiment of a protective garment for operation in contaminated areas in accordance with the invention, made with reference to the attached drawings, given by way of non-restrictive example, in which.

Figure 1:
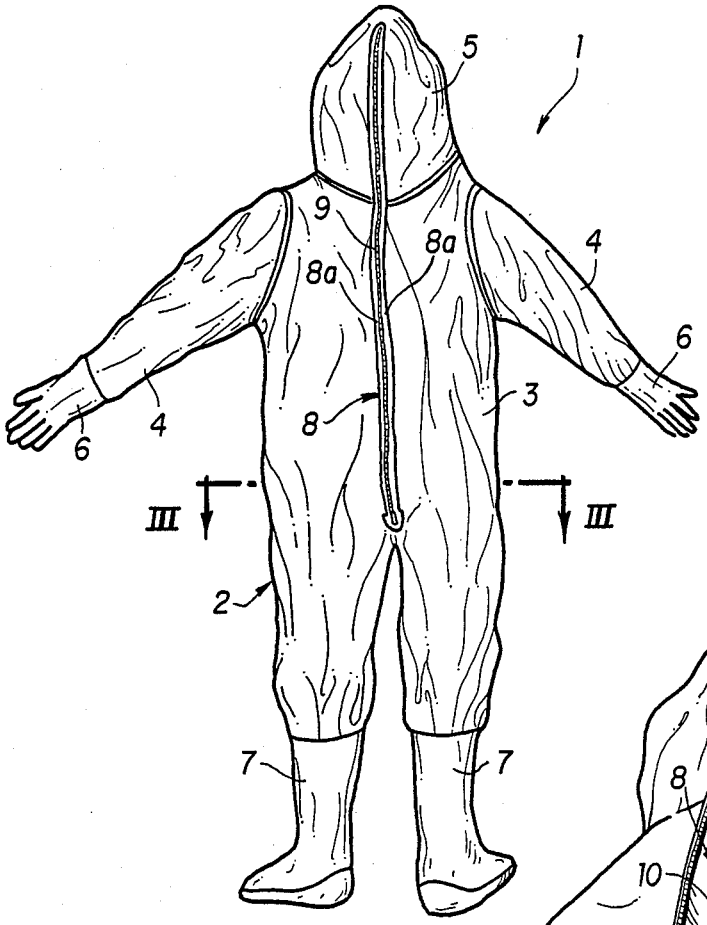
FIG. 1 is a back view of the garment correctly worn.
Figure 4:
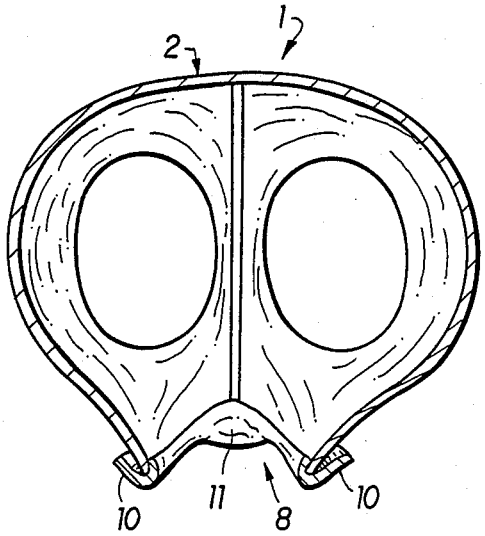
Figure 5:
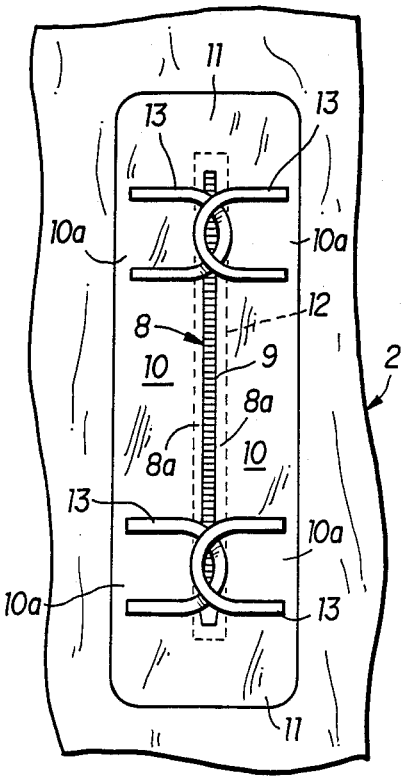
Figure 6:
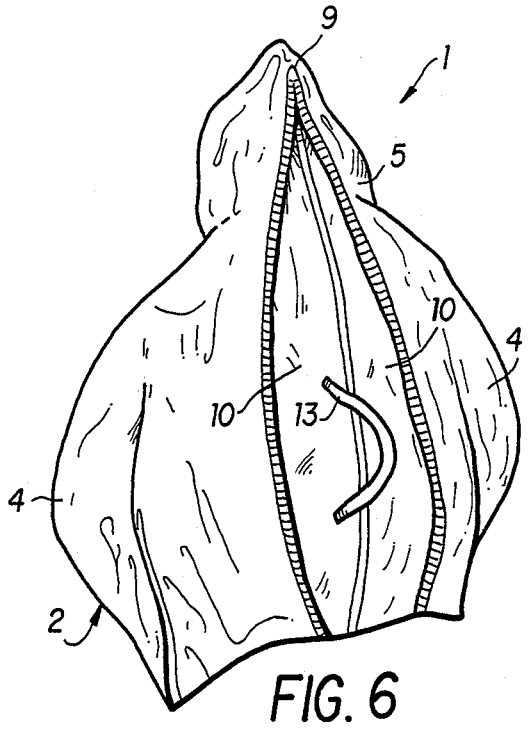
Figure 7:
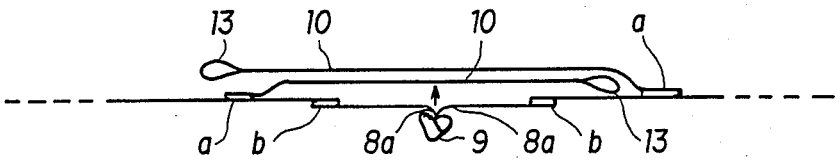
Figure 8:
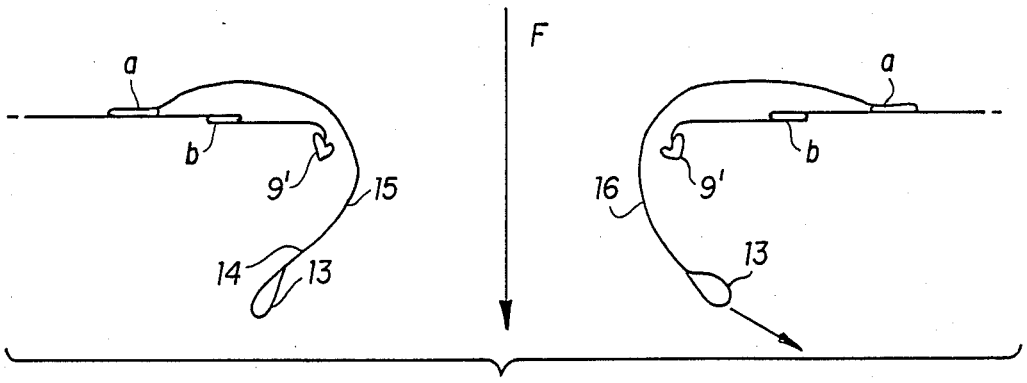

FIG. 4 is a diagrammatic section of the garment, taken along line III—III of FIG. 1, but with the protective skirts in service position, FIG. 5 represents a detail of the garment of FIG. 1, as viewed from inside the garment, FIG. 6 is a preferred alternative embodiment of the invention referred to FIG. 1 and following opening of the slit, and FIGS. 7 and 8 represent cross-sections of the alternative embodiment shown in FIG. 6.

In these figures, the reference numeral 1 indicates in its entirety the protective garment for operation in contaminated areas in accordance with the present invention. Garment 1 comprises a suit 2 made of impermeable material and composed of a central body 3 covering waist and legs, to which are applied sleeves 4, and a hood 5. These elements are joined together in per se conventional manner to insure a perfect and permanent seal. For example, the suit may be made of a synthetic fabric coated inside and outside with a conventional rubber compound.

The suit 2 is provided in an airtight manner with gloves 6, boots 7 and a facial mask, not shown in the drawings, attached to the front of hood 5.

Garment 1 may be put on and taken off by the wearer through a slit 8 which can be opened, and which extends vertically in the back region of the suit 2.

Slit 8 is provided with edges **8*a* mutually abuttable and tightly engageable together by suitable closing means, preferably represented by an appropriate zipper 9** slidable on opposing teeth.

In accordance with the present invention, a protective skirt 10, also made of impermeable material, is respectively secured along each of the edges **8*a***, at the side directed towards the inside of the garment.

The protective skirts 10 are mutually connected, at their respective opposite ends, by two auxiliary protective portions 11, each of which is fixed to the suit 2 at one end of slit 8.

As best shown in FIG. 5, in a preferred embodiment of the invention skirts 10 and the auxiliary portions 11 are made as a single rectangular piece provided with a longitudinal cut corresponding to slit 8 and secured inside the garment 1, for instance by bonding, along a profile shown by dashed lines and indicated by 12, which extends around said slit 8 and is adjacent to it.

With each protective skirt 10 gripping means are associated which comprise handles 13, each of which is fastened to a free edge 10*a* of the corresponding skirt 10 and, when garment 1 is correctly worn, extends towards slit 8, terminating at that slit. In this way each handle 13 can be easily gripped from the outside of the garment through slit 8.

Figure 3:
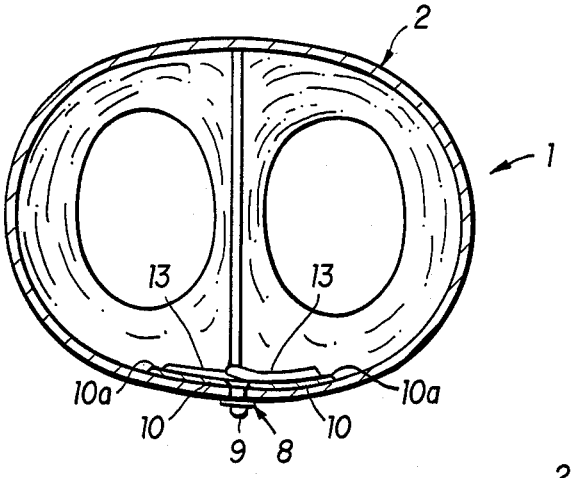
FIG. 3 is a diagrammatic section taken along line III—III of FIG. 1.

The manner of use of the garment will now be described:

As clearly shown in FIGS. 1 and 3, when the garment 1 is correctly worn, zipper 9 closes the slit 8 in a tight way. Further, in this situation the protective skirts 10, together with the axuiliary protective portions 11, are in a rest position in which they are fully enclosed within garment 1, extending towards opposite directions from the corresponding edges of slit 8 (FIG. 3).

Handles 13 are reversed on siirts 10 and extend in accordance with the above.

Under these conditions the skirts 10, the auxiliary portions 11, and the handles 13, being fully enclosed within the garment 1, are protected against the action of contaminating substances during operation in contaminated areas.

As skirts 10 and handles 13 are made of a comparatively soft material, their presence inside the garment 1 is not annoying for the operator during the performance of the necessary operations.

When the operations are over and, after a decontaminating treatment, garment 1 is to be taken off by the wearer, an assistant, provided with appropriate gloves, opens zipper 9 and grips handles 13 to draw them out of the garment. This operation carried out on handles 13 causes the reversal of the protective skirts 10 and of the auxiliary protective portions 11.

Figure 2:
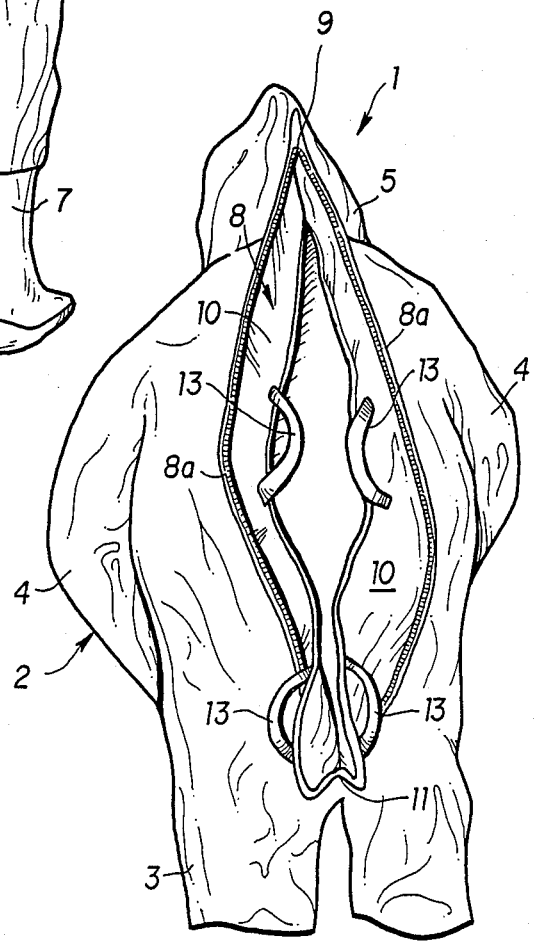
FIG. 2 is a perspective back view of the garment in an initial taking-off phase.

In this way said skirts 10 and auxiliary portions 11 are brought from a rest position to a work position, in which the skirts 10 are reversed and positioned astride the corresponding edges 8*a*, as shown in FIG. 4, and the auxiliary portions 11 are reversed and positioned astride the respective ends of slit 8, as shown in FIG. 2 in respect of the portion 11 situated in the low position.

Under these conditions, skirts 10 and the auxiliary portions 11, whose surfaces have not been contaminated during operation, are adapted to release the wearer from the risk of contacting the outer surface of the garment in the proximity of slit 8 during the removal of the garment itself.

The invention will now be described with reference to a preferred embodiment concerning the protective skirts 10 and their position inside the garment. In this embodiment, FIG. 1 is still referred to show the garment with slit 8 in closed position. As already said, the garment comprises skirts 10 and auxiliary protective portions 11.

FIGS. 6 to 8 have the same reference numerals as in the preceding figures in respect of the particulars of the garment already described.

The main feature of the invention, in this preferred embodiment, is based on the fact that the extreme portions of the two skirts 10, made of impermeable material and having the task of protecting the wearer during the removal of the suit, are associated with two zones a—a situated to the rear (FIGS. 7, 8) with respect to the two edges 8*a* of the slit.

As shown in FIG. 7, the skirts 10 extend from their zones of application a—a in opposite direction with respect to each other and are mutually superimposed.

Preferably, the zones of application a—a of the two skirts 10 are situated at a distance from the edges 8*a* which ranges between 2 and 5 cm.

The skirts 10 are applied to the suit by bonding or by sewing. Further each skirt 10 comprises, at its free end, gripping means constituted by handles 13.

In a still further alternative embodiment of the invention, the portions of the zippers comprising edges 8*a* may be joined to the suit 2 by bonding along two zones b—b, as diagrammatically indicated in FIGS. 7 and 8.

This invention readily accomplishes its intended purpose. In fact, the presence of the protective skirts 10 and the auxiliary protective portions 11 enables the protective garment to be taken off—obviously with the appropriate care—in conditions of absolute safety, even if contaminating substances deposited during operation in contaminated areas remain present on its outer surface.

After removal, the protective garment may be subjected to suitable decontaminating treatments, even at high temperatures, if desired, so as to eliminate therefrom any trace of contamination.

More particularly, under working conditions the protective garment described above with reference to FIGS. 6 to 8 is provided with a double protective layer formed by the two skirts 10 superimposed over each other (see FIG. 7).

In practice, as the ends of the skirts 10 are brought to a predetermined distance from edges 8*a* and said skirts are directed towards opposite positions, a safety barrier is created against any contaminating substances which may have occasionally penetrated the suit through any small imperfection of zipper 9 or of the teeth 9′ on which it slides. In fact even assuming that some contaminating substances may have contacted the first skirt 10, they will soon encounter a mechanical obstacle, difficult to be overcome, represented by the second skirt 10 (see FIG. 6).

Consequently, in accordance with the present invention it is possible to eliminate the risk of any harmful contact between the wearer and the contaminants during any work activity carried out in contaminated areas. Moreover, when the garment is taken off after decontamination, any possible contaminating substances that may have penetrated through the zipper and become deposited on the first skirt 10 are prevented from contacting the wearer during removal of the suit.

In fact, the taking-off phase is effected with the aid of an assistant, provided with perfectly clean gloves, who has the task of opening the slit by sliding zipper 9 on edges 8*a* and then, by gripping the two handles 13, of effecting the enlargement and the reversal of the skirts 10 towards the garment outside, as shown in FIG. 8. Under these circumstances, the outermost surface 14 of the first skirt 10, carrying possible contaminating substances, is excluded from any contact with the wearer who, at the most—following the direction of arrow F during his emerging from the suit—might come into contact with the inner surfaces 15 and 16 of skirtings 10, which are devoid of any contaminating substance, as explained above.

A further important feature of the preferred embodiment of this invention resides in providing two skirts 10 whose handles 13 are in a position very near to that of the edges 8*a* of slit 8. In fact, by this arrangement, the taking-off operation, after the opening of the slit, is effected at once, thus releasing the wearer from an impermeable garment within which he has been enclosed for the whole time of activity in a contaminated area, with consequent serious tiring and psychic stress.

Moreover, the presence of handles 13, located in proximity of the edges 8*a* of the slit, limits the action of the assistant to a very limited portion of the garment, which is in any event protected by the superimposed skirts 10, thus avoiding the possibility that any traces of contaminants occasionally deposited on the gloves of said assistant acting on the slit may come into contact with the wearer.

Although preferred embodiments of the invention have been described and illustrated, it is to be understood that the invention includes within its scope any other alternative embodiment deriving from the above-indicated inventive ideas.

What is claimed is:

1. A protective garment for operation in contaminated areas, of the type comprising an impermeable suit provided with boots, gloves, hood and facial mask, as well as with at least one slit which can be opened, along the opposite edges of which operate tight closing means, characterized in that it comprises at least one pair of protective skirts secured inside the garment along opposite sides of the slit, the skirts being provided with gripping means to be brought from a rest position, in which they are enclosed within the garment and extend in opposite directions, to a working position in which each skirt is reversed astride the corresponding edge of the slit.

2. A protective garment as in claim 1, characterized in that said pair of protective skirts is secured inside the garment along two zones distant from the slit edges, said skirts extending from said zones towards opposite directions and being superimposed to create a double protective layer around the slit closed by said sealing means.

3. A protective garment as in claim 1, characterized in that said protective skirts are secured inside the garment, each along one edge of the slit, the skirts being capable of being reversed by said gripping means from a rest position, in which they are enclosed within the garment and extend in opposite directions from the edges of the slit, to said working position, in which each skirt is reversed astride the corresponding edge of the slit.

4. A protective garment as in any one of claims 1 to 3, characterized in that said protective skirts are mutually connected by auxiliary protective portions, each located at one end of the slit and adapted to be brought, together with the protective skirts, from a rest position, in which said auxiliary protective portions are enclosed within the garment, to a working position in which each auxiliary protective portion is reversed astride the corresponding end of the slit.

5. A protective garment as in claim 1, characterized in that said gripping means, for each of said skirts, comprise at least one gripping handle fastened to a free edge of said skirting.

6. A protective garment as in claim 4, characterized in that said protective skirts and said auxiliary protective portions are made from a single piece.

7. A protective garment as in claim 1, characterized in that said slit extends vertically in the back region of the garment.

8. A protective garment as in claim 2, characterized in that each skirt is fastened to said zone at a distance from the edge which ranges between 2 and 5 cm.

9. A protective garment as in claim 2, characterized in that the ends of said skirts are bonded to the garment along said zones.

* * * * *